US008794376B2

(12) United States Patent
Shults et al.

(10) Patent No.: US 8,794,376 B2
(45) Date of Patent: Aug. 5, 2014

(54) FIREARM FLASH SUPPRESSOR SYSTEM

(71) Applicant: Silencerco, LLC, West Valley City, UT (US)

(72) Inventors: Jonathon Shults, Sandy, UT (US); Harrison Holden, Sandy, UT (US); Casey Brandol, Salt Lake City, UT (US)

(73) Assignee: Silencerco, LLC, West Valley City, UT (US)

( * ) Notice: Subject to any disclaimer, the term of this patent is extended or adjusted under 35 U.S.C. 154(b) by 0 days.

(21) Appl. No.: 13/743,331

(22) Filed: Jan. 16, 2013

(65) Prior Publication Data

US 2014/0020977 A1 Jan. 23, 2014

Related U.S. Application Data

(60) Provisional application No. 61/587,118, filed on Jan. 16, 2012.

(51) Int. Cl.
*F41A 21/34* (2006.01)
*F41A 21/32* (2006.01)
*F41A 21/30* (2006.01)

(52) U.S. Cl.
CPC ..... *F41A 21/30* (2013.01); *F41A 21/325* (2013.01); *F41A 21/34* (2013.01)
USPC ..... 181/223; 89/14.2

(58) Field of Classification Search
CPC ..... F41A 21/30
USPC ..... 181/223; 89/14.2, 14.4
See application file for complete search history.

(56) References Cited

U.S. PATENT DOCUMENTS

| | | | | |
|---|---|---|---|---|
| 2,870,679 | A * | 1/1959 | Collins | 89/14.2 |
| 2,900,875 | A | 8/1959 | Fergus et al. | |
| 4,588,043 | A | 5/1986 | Finn | |
| 4,757,741 | A * | 7/1988 | Brothers | 89/14.05 |
| 4,893,544 | A * | 1/1990 | Hawley et al. | 89/14.2 |
| 5,164,535 | A | 11/1992 | Leasure | |
| 5,596,161 | A | 1/1997 | Sommers | |
| 6,837,139 | B2 | 1/2005 | Meyers | |
| 7,302,774 | B2 | 12/2007 | Meyers | |
| 7,594,464 | B2 | 9/2009 | Dueck | |
| 7,905,170 | B1 | 3/2011 | Brittingham et al. | |
| 2007/0266844 | A1 | 11/2007 | Dueck | |
| 2009/0178549 | A1 | 7/2009 | Meyers | |
| 2010/0139145 | A1 | 6/2010 | Brittingham | |
| 2010/0313743 | A1 | 12/2010 | Dueck et al. | |
| 2011/0061966 | A1 | 3/2011 | Brittingham | |
| 2011/0067950 | A1 | 3/2011 | Shults et al. | |
| 2011/0072958 | A1 | 3/2011 | Brittingham et al. | |

OTHER PUBLICATIONS

Korean Intellectual Property Office, "International Search Report and Written Opinion," mailed Jun. 2, 2013, in related PCT application No. PCT/US2013/021781.

* cited by examiner

*Primary Examiner* — Jeremy Luks
(74) *Attorney, Agent, or Firm* — Durham Jones & Plnegar Intellectual Property Law Group

(57) ABSTRACT

A flash suppressor adapted to be attached to a muzzle of a barrel of a firearm coaxially therewith, the flash suppressor having a base, a tapered waist portion and a shoulder surface. The flash suppressor further having a plurality of tines, in which each tine of the plurality of times has a different mass to affect sound reduction as a result of expanding, and combusting gases exiting the muzzle of the firearm when the firearm is discharged.

15 Claims, 9 Drawing Sheets

FIREARM FLASH SUPPRESSOR SYSTEM

CROSS-REFERENCE TO RELATED APPLICATION

A claim for priority to the Jan. 16, 2012, filing date of U.S. Provisional Patent Application No. 61/587,118, titled FIREARM NOISE SUPPRESSOR SYSTEM ("the '118 Provisional Application"), is hereby made pursuant to 35 U.S.C. §119(e). This application is also related to U.S. patent application Ser. No. 13/743,328, titled FIREARM FLASH SUPPRESSOR SYSTEM ("the '328 Application") filed Jan. 6, 2013, which application also claims priority to the '118 Provisional Application. The entire disclosures of the foregoing '118 Provisional Application and '328 Application are, by this reference, incorporated herein.

FIELD OF THE INVENTION

The present invention relates to a flash suppressor for a firearm and to systems for removably attaching a noise suppressor or other auxiliary device to the muzzle of a firearm barrel.

BACKGROUND OF THE INVENTION

Noise suppressors for firearms are well known in the prior art, and many have been patented over a considerable period of time. Many different techniques have been developed and patented, and flash suppressors and baffles of varying designs have been extensively used. The aim and intention of a noise suppressor, regardless of the technique used, is to reduce the pressure and velocity of the propellant gases from the noise suppressor so that the resulting sound level is significantly reduced.

Prior art noise suppressors include flash suppressor systems and internal baffles for reducing the muzzle flash of a firearm when it has been discharged. Previous flash suppressor designs provide a combination of features which have culminated in systems for reducing the muzzle flash of a firearm to various degrees. B.E. Meyers' four tine design, U.S. Pat. Nos. 6,837,139 and 7,302,774 (Myers), Smith Enterprises' Vortex flash suppressor, U.S. Pat. No. 5,596,161 (Sommers), and Advanced Armament Corp.'s flash suppressor, U.S. Pat. No. 7,905,170 (Brittingham), are currently available in the market place. The aforementioned designs fail to provide several features necessary and desirable for today's firearms. Most particularly, and as exemplified by Advanced Armament Corp.'s flash suppressor, the design of the respective tines of the flash suppressor results in an undesirable "ringing" tone to be emitted from the flash suppressor upon the discharge of the firearm due to imparted harmonics on the respective tines of the firearm.

Quite complex baffle structures are known in the prior art. Some of these baffles have more recently used asymmetric features, such as slanted sidewalls or baffles that have been positioned at an angle to the bore, to achieve high levels of sound reduction. U.S. Pat. No. 4,588,043 (Finn) and U.S. Pat. No. 5,164,535 (Leasure) are indicative of the complex baffles using slanted sidewalls or asymmetric cuts into the bore of the baffles. Known prior art as practiced also includes baffles known as "K" baffles, where the baffle consists of a flat flange joined to a conical section by a web. An inner chamber is formed between the front face of the flat flange and the rear face of the conical section. The "K" baffle first appeared during the mid-1980s, and while initially symmetrical venting or porting was used to vent gases into the inner chamber between the rear and front faces of the baffle, slanted sidewalls were used to improve the performance of the "K" baffle, as well as asymmetric cuts or scoops on the rear face and on the conical front face, with the scoop on the front face penetrating through the conical front face and into the inner chamber. This had the effect of venting gases into the inner chamber, which enhanced the sound reduction of the suppressor. These asymmetric cuts or scoops are similar to the slanted sidewall feature of the Finn patent in that the cuts or scoops are positioned 180 degrees apart. However, while such a modified "K" baffle works well with pistol caliber firearms, the asymmetry causes some detrimental effects on accuracy when used with rifle caliber firearms, and requires an increase in the size of the bore aperture of the baffle to ensure minimization of bullet yaw. This would otherwise result in projectiles striking the baffles and the end cap of the suppressor. What is required is a baffle that offers high levels of sound reduction, minimizes bullet yaw and enhances and/or maintains the normal accuracy of the host firearm.

Accordingly, there is a need for a noise suppressor for a firearm using flash suppressors and baffles that have little or no detrimental effect on the accuracy of the fired projectile, and produce high levels of sound and flash reduction. This is achieved through the use of a flash suppressor and downstream baffles whose design provides enhanced performance over the prior art systems.

Further, various systems are known in the firearms art for attaching a noise suppressor to a firearm, and specifically for removably attaching a noise suppressor to a flash suppressor affixed to the muzzle end of a firearm. There nevertheless exists a need for improving such systems, particularly for increasing the ease by which a user may attach a noise suppressor to a flash suppressor while at the same time affecting a reliable securement therebetween capable of withstanding vibrations incidental to the firing of such firearms as automatic rifles used by military personnel.

SUMMARY

This application relates to a suppressor for a firearm. More specifically, this application relates to a noise suppressor system for attachment to a firearm including a barrel having a longitudinal axis, comprising the combination of: a flash suppressor adapted to be attached to the muzzle of the barrel coaxially therewith and a noise suppressor including a proximal mount assembly having an interior expansion chamber for coaxially receiving the flash suppressor. Additionally, this application relates to a system for selectively securely coupling the noise suppressor system to the firearm.

In one aspect, the flash suppressor of the noise suppressor system provides a means for suppressing or hiding the flash of the firearm, which is the result of expanding and combusting gases exiting the muzzle of a host firearm when discharged. In one aspect, the flash suppressor utilizes tines that are sized and shaped to provide advantageous sound reduction characteristics over conventional tine noise suppressors. Conventionally, the heat and pressure from expanding gases which are the result of discharging a firearm may cause the tines of a flash suppressor to resonate. This resonation is a concern due to the audible ringing tone emitted by the flash suppressor as a result of the harmonic interaction of the conventionally sized and shaped tines of the prior art flash suppressors. While the conventional tines of prior art flash suppressors are identically sized and shaped, each tine of the disclosed flash suppressor has a different mass, which results in minimal to no induced harmonic noise being emitted by the flash suppressor upon the discharge of the firearm.

The noise suppressor of the noise suppressor system can comprise a cylindrical housing, a proximal mount assembly having a means for selective attachment to the flash suppressor and to the cylindrical housing, a distal end cap with means for attachment to the housing, and a plurality of baffles positioned within the housing and between the proximal mount assembly and the distal end cap of the noise suppressor. In one aspect, separate cylindrical spacer elements, or "spacers," can be positioned between the proximal mount assembly and the distal end cap of the noise suppressor and between the baffles. These spacers provide for desired axial positioning of the baffles within the cylindrical housing of the noise suppressor. As one skilled in the art will appreciate, the distal end cap of the noise suppressor is provided with a concentric circular hole or aperture for the projectile to pass through the end of the noise suppressor. Further, a plurality of expansion chambers are formed between the baffles within the noise suppressor.

In a number of aspects, the noise suppressor utilizes baffles that can use at least one of the disclosed features that enhance reduction of sound and flash, these features including a proximally facing first frusto-conical section in communication with a central bore sized and shaped for the projectile to pass therethrough, a distally facing second frusto-conical section having at least one circumferentially extending shoulder element positioned at the distal edge of the first frustro-conical section to induce turbulence into the gas stream as the gas stream moves distally toward the concentric circular hole or aperture in the distal end cap of the suppressor, and at least one gas cross-flow aperture positioned proximate the proximal end of the second frusto-conical section to direct a substantially perpendicular gas jet onto the discharge gas stream as the discharge gas stream passes the at least one gas cross-flow aperture.

DESCRIPTION OF THE FIGURES

These and other features of the preferred embodiments of the invention will become more apparent in the detailed description in which reference is made to the appended drawings wherein.

DETAILED DESCRIPTION OF THE INVENTION

Embodiments of the present invention can be understood more readily by reference to the following detailed description, examples, drawings, and claims, and their previous and following description. However, before the present devices, systems, and/or methods are disclosed and described, it is to be understood that embodiments described herein are not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the invention in its best and currently known embodiments. To this end, those skilled in the relevant art will recognize and appreciate that many changes can be made to the various aspects of the invention described herein, while still obtaining the beneficial results of the described embodiments. It will also be apparent that some of the desired benefits of the embodiments of the present invention can be obtained by selecting some of the features described herein without utilizing other features. Accordingly, those who work in the art will recognize that many modifications and adaptations are possible and can even be desirable in certain circumstances and are a part of the embodiments of the present invention. Thus, the following description is provided as illustrative of the principles of the embodiments of the present invention and not in limitation thereof.

As used throughout, the singular forms "a," "an" and "the" include plural referents unless the context clearly dictates otherwise. Thus, for example, reference to "a slot" can include two or more such slots unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 3:
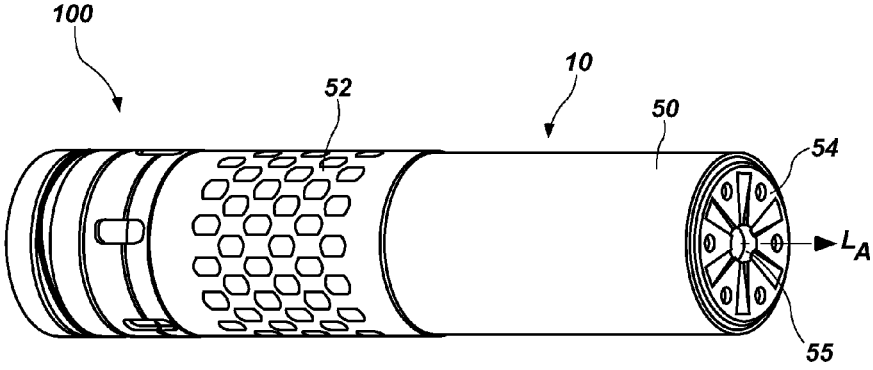
FIG. 3 is a distal side perspective view of the noise suppressor system of FIG. 1.
Figure 4:
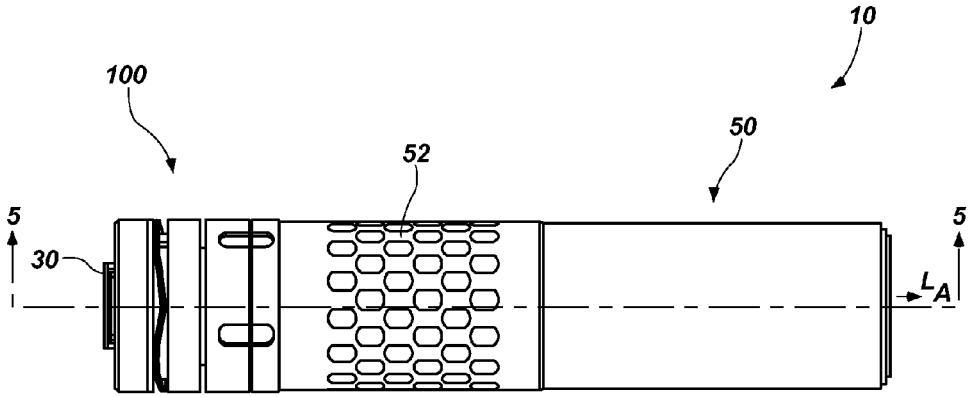
FIG. 4 is a side plan view of the noise suppressor system of FIG. 1.
Figure 5:
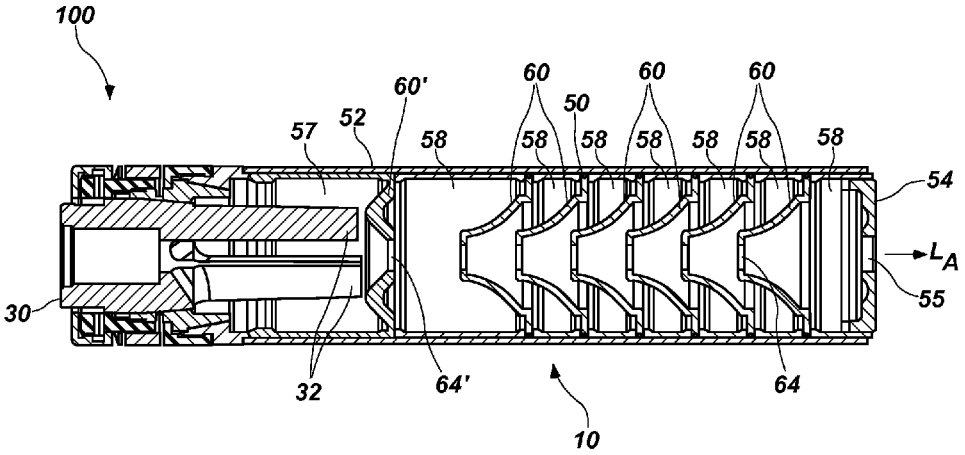
FIG. 5 is a cross-sectional view of the noise suppressor system of FIG. 4, taken along lines 5-5 of FIG. 4.
Figure 6A:
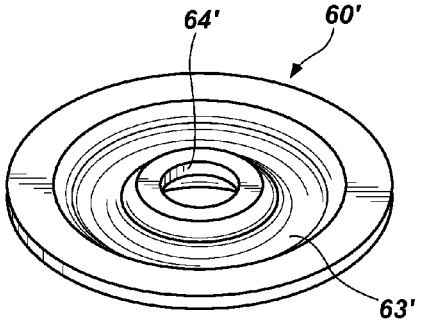
FIG. 6A is a distal perspective view of a first baffle of a plurality of baffles of the noise suppressor of FIGS. 1 and 3-5, according to one view.
Figure 6B:
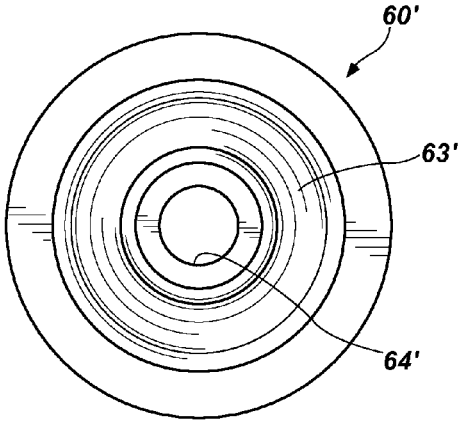
FIG. 6B is a distal top plan view of the first baffle of FIG. 6A.

As used herein, the words "front," "forward," and "distal" correspond to the firing direction of the firearm (i.e., to the right as shown in FIGS. 3-5); "rear" and "rearward," "back," and "proximal" correspond to the direction opposite the firing direction of the firearm (i.e., to the left as shown in FIGS. 3-5); "longitudinal" means the direction along or parallel to the longitudinal axis of the barrel of the firearm or of the noise suppressor system 10; and "transverse" means a direction perpendicular to the longitudinal direction.

A system and device for suppressing noise from a firearm is presented. More specifically, and as generally shown in FIGS. 1-14, this disclosure relates to a noise suppressor system 10 for attachment to a firearm including a barrel having a longitudinal axis, comprising the combination of: a flash suppressor 30 adapted to be attached to the muzzle of the barrel coaxially therewith and a noise suppressor 50 including a proximal mount assembly 100 having a bore for coaxially receiving the flash suppressor 30. Additionally, this disclosure relates to a system for selectively securely coupling the noise suppressor system 10 to a firearm.

It is contemplated that the noise suppressor system 10 can be configured for use with conventional weaponry, for example and without limitation, standard United States military weaponry, particularly the AR-15 and M-16 firearms. These firearms have a standard bore of .223 caliber (5.56 mm). Further, such firearms have a barrel with a conventional male threaded extension.

In one aspect and as shown in FIGS. 10-14, the flash suppressor 30 of the noise suppressor system 10 provides a means for suppressing or hiding the flash of the firearm, which is the result of expanding and combusting gases exiting the muzzle of a host firearm when discharged. In one aspect, the flash suppressor 30 comprises tines 32 that are sized and shaped to provide advantageous sound reduction characteristics over conventional tine noise suppressors. Conventionally, the heat and pressure from expanding gases which are the result of discharging a firearm may cause the tines of a flash suppressor to resonate. This resonation is a concern due to the audible ringing tone emitted by the flash suppressor as a result of the harmonic interaction of the conventionally sized and shaped tines of the prior art flash suppressors. While the conventional tines of prior art flash suppressors are identically sized and shaped, each tine 32 of the disclosed flash suppressor 30 has a different mass, which results in minimal to no induced harmonic noise being emitted by the flash suppressor 30 upon the discharge of the firearm. It is contemplated that the respective masses of the tines 32 can vary by less than 1%, less than 2%, less than 3%, less than 4%, less than 5%, less than 6%, less than 7%, less than 8%, less than 9%, less than 10%, less than 11%, less than 12%, less than 13%, less than 14%, less than 15%, less than 16%, less than 17%, less than 18%, less than 19%, less than 20%, less than 25%, less than 30%, less than 35%, less than 40%, less than 45%, or less than 50%. Optionally, the respective masses of the tines 32 can vary by at least 1%, at least 2%, at least 3%, at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, at least 20%, at least 25%, at least 30%, at least 35%, at least 40%, at least 45%, or at least 50%.

As shown in the figures, one contemplated way to vary the respective masses of the individual tines 32 is to vary the respective lengths of the otherwise substantially identical shaped and sized tines 32.

In one aspect, the flash suppressor 30 generally includes a cylindrical socket 33 which has a threaded recess for receiving the threaded extension of the gun barrel. In another aspect, the cylindrical socket 33 defines an axial central bore 35 having a diameter that is slightly larger than the bore of the firearm to which the flash suppressor 30 is attached so as to prevent the exiting projectile from touching any portion of the flash suppressor 30 as it proceeds.

In a further aspect, the body of the flash suppressor 30 surrounding the exit chamber can comprise a plurality of equally spaced angled troughs 34 running the length of the exit chamber and a plurality of distally longitudinally extending slots 36 defined in a forward portion of the flash suppressor. In the example illustrated in FIGS. 10-14, there are exemplarily three equally spaced angled troughs 34 and three longitudinally extending slots 36. In an optional aspect, the troughs 34 have radius ends at their proximal ends and are open at their distal ends, thereby defining a concave profile. Optionally, and as may be seen on FIGS. 13 and 14, the troughs 34 can be positioned slightly offset from tines 32, which are defined between adjacent slots 36.

In one aspect, the exterior surface of the body of the flash suppressor 30 has a tapered waist portion 38. The tapered waist portion 38 tapers inwardly (i.e., to a smaller diameter) from its proximal side to its distal side. As will be explained in a later portion of this application, the tapered waist portion 38 of the flash suppressor 30 provides a surface for a compressive friction fit with a complementarily tapered interior surface of an intermediate body member of the proximal mount assembly 100. Further, the peripheral edge surface of the back end of the body of the flash suppressor 30 defines at least one key surface 40 that is complementarily shaped to mate within a recess defined therein the top surface of the proximal attachment cap of the proximal mount assembly 100. In addition, intermediate the tapered waist portion 38 and the back end of the flash suppressor 30, a shoulder surface 42 can be defined that allows for selective compressive contact with portions of the plurality of cam members of the proximal mount assembly 100. Optionally, wrenching flats 44 can be defined on portions of the exterior surface of the flash suppressor 30 intermediate the shoulder surface 42 and the back end of the flash suppressor 30.

In an optional aspect, at least a portion of the exterior surface of each tine 32 can taper inwardly (y) toward the central longitudinal axis of the flash suppressor 30. In operation, and as shown in the figures, in the noise suppressor system 10, the respective tines 32 are well spaced from the interior portion of the suppressor housing when the noise suppressor 50 (FIGS. 1-5) is selectively mounted to the flash suppressor 30, thereby providing adequate spacing and helping to prevent copper and carbon build up from inhibiting the removal of the noise suppressor 50.

With reference to FIGS. 1-5, the noise suppressor 50 for the firearm can comprise a cylindrical housing 52, a proximal mount assembly 100 having a means for selective attachment to the flash suppressor 30 and to the cylindrical housing 52, a distal end cap 54 with threaded means for attachment to the cylindrical housing 52, and a plurality of baffles 60 positioned within the cylindrical housing 52 and between the proximal mount assembly and the distal end cap 54 of the noise suppressor 50. In one aspect, separate cylindrical spacer elements 62, which are referred to herein as "spacers 62" can be positioned between the proximal mount assembly and the distal end cap 54 of the noise suppressor 50 and between the baffles 60. These spacers 62 provide for desired axial positioning of the baffles 60 within the cylindrical housing 52 of the noise suppressor 50. As one skilled in the art will appreciate, the spacers 62 can be integrally formed as a distal portion of each of the respective baffles 60 and are shown and described as such for convenience. In a further aspect, the distal end cap 54 of the noise suppressor 50 is provided with a concentric circular hole or aperture 55 for a projectile to pass through the end of the noise suppressor 50. Further, a plurality of expansion chambers 58 are formed between the baffles 60 within the noise suppressor 50.

In a number of aspects, the noise suppressor 50 utilizes baffles 60 that use at least one of the disclosed features that enhance reduction of sound and flash. In one optional aspect, as depicted by FIGS. 8A-9B, these features can include one or more of: a proximally facing frusto-conical section 63 in communication with a central bore 64 sized and shaped for the projectile to pass through, a distally facing surface 70 of the frusto-conical section 63 having at least one circumferentially extending shoulder element 72 positioned at the distal edge 74 of the frusto-conical section 63 to induce turbulence into the gas stream as the stream moves distally to be vented from the aperture 55 in the distal end cap 54 (FIGS. 1, 3 and 5) of the noise suppressor 50, and at least one gas cross-flow aperture 80 positioned proximate the proximal end 76 of the frusto-conical section 63 to direct a substantially perpendicular gas jet onto the discharge gas stream as the discharge gas stream passes the at least one gas cross-flow aperture 80.

As shown in FIG. 5, the noise suppressor 50 of the noise suppressor system 10 can define an interior expansion chamber 57 in the proximal end portion of the cylindrical housing 52 having an enlarged diameter. As shown in the figures, the distal portions of the tines 32 of the flash suppressor 30 are positioned in the interior expansion chamber 57 of the noise suppressor 50 when the noise suppressor 50 is operatively coupled to the flash suppressor 30.

In one aspect, the noise suppressor 50 can comprise a first baffle 60' positioned adjacent and downstream of the interior expansion chamber 57 and a plurality of second baffles 60", as described previously herein, that are sequentially positioned downstream of the first baffle 60'. In one aspect, it is contemplated that the plurality of spaced baffles 60 extends along a bullet or projectile pathway. Each baffle 60, 60' can define a central bore 64, 64' that is coaxial with the bullet pathway (see, e.g., FIGS. 6A-7B). Further, it will be appreciated that the plurality of spaced second baffles 60' defines a plurality of adjacent chambers that are spaced along the longitudinal axis of the cylindrical housing 52. In further aspects, each baffle 60, 60' can substantially separate the adjacent chamber and at least a portion of at least one of the baffles 60, 60' can lie in a plane that is transverse to the bullet pathway.

In one aspect, and referring to FIGS. 5-7B, the first baffle 60' can comprise proximally facing section 62' that has a proximally facing circular male ridge 61' extending proximally therefrom. In this aspect, the male ridge 61' can be spaced radially from and in communication with a central bore 64' sized and shaped for the projectile to pass through. In another aspect, a distally facing section of the first baffle 60' can define a circular trough 63' that can be spaced radially from and in communication with the central bore 64'. As shown in FIG. 5, the central bore 64' of the first baffle 60' is co-axial with the axial central bore 35 of the flash suppressor 30. In one aspect, the central bore 64' can comprise a limited elongate length extending parallel to the longitudinal axis of the noise suppressor 50.

Figure 7A:
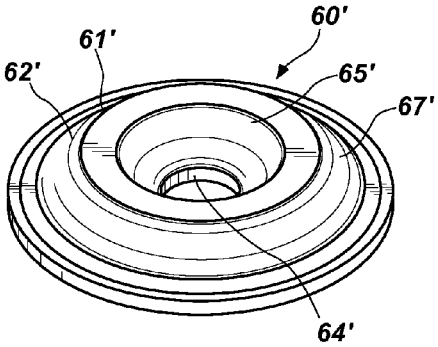
FIG. 7A is a proximal perspective view of the first baffle of FIG. 6A.
Figure 7B:
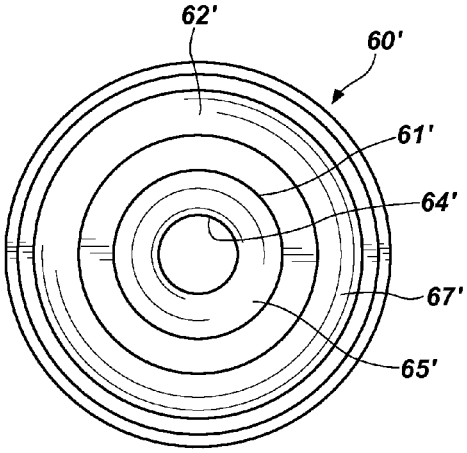
FIG. 7B is a proximal top plan view of the first baffle of FIG. 6A.
Figure 8A:
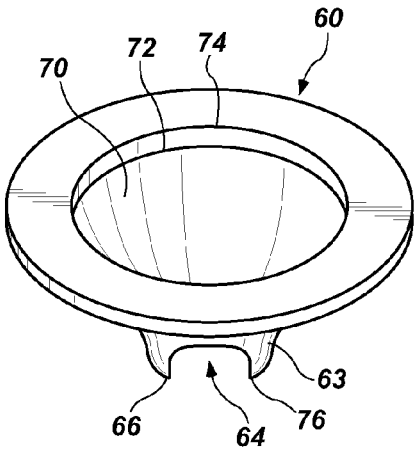
FIG. 8A is a distal perspective view of a second baffle of a plurality of baffles of the noise suppressor of FIGS. 1 and 3-5, according to one view.
Figure 8B:
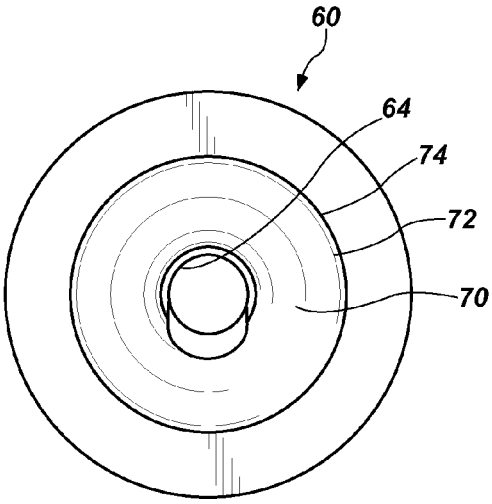
FIG. 8B is a distal top plan view of the second baffle of FIG. 8A.
Figure 9A:
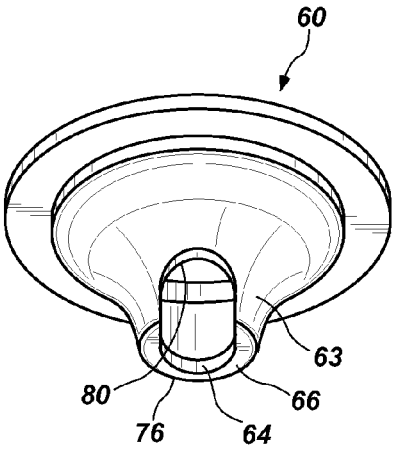
FIG. 9A is a proximal perspective view of the second baffle of FIG. 8A.
Figure 9B:
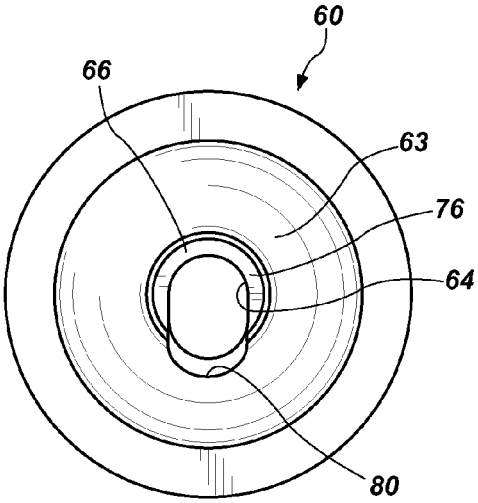
FIG. 9B is a proximal top plan view of the second baffle of FIG. 8A.
Figure 10:
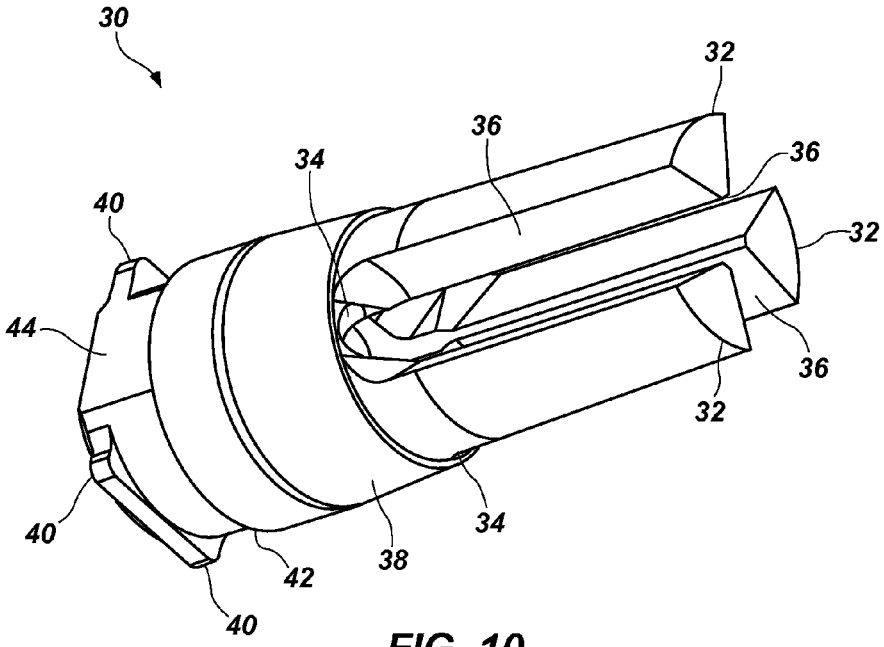
FIG. 10 is a front perspective view of a flash suppressor of the noise suppressor system, according to one aspect.
Figure 11:
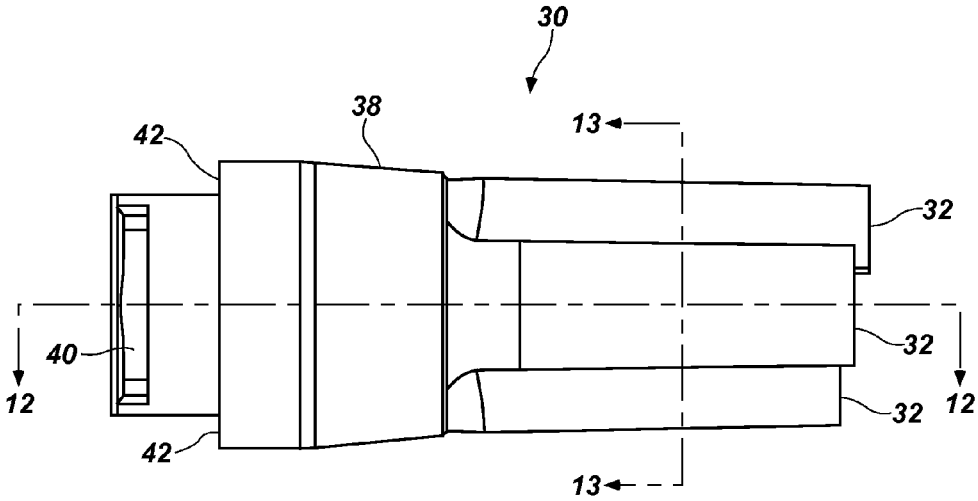
FIG. 11 is a side plan view of the flash suppressor of FIG. 10.

In one aspect, as illustrated by FIGS. 7A and 7B, it is contemplated that the proximally facing section 62' of the first baffle 60' can have a substantially "M" cross-sectional shape, in which the proximally facing section 62' (in cross-section) has an inner surface 65' adjacent and facing inwardly toward the central bore 64' and an outer surface 67' that faces outwardly away from the central bore 64'. In one aspect, it is contemplated that the inner surface 65' can be sized and shaped to selectively direct a percentage of discharged gas initially through the central bore 64' and into communication with the downstream plurality of second baffles 60 and the outer surface 67' can be configured to aid in recirculating discharge gases that impact the outer surface 67' within the interior expansion chamber 57 (FIG. 5) until eventual discharge through the central bore 64'.

In one aspect, it is contemplated that the inner surface 65' of the proximally facing section 62' can be angled (β) with respect to the longitudinal axis from between about 20° to about 70°, from between about 30° to about 60°, from between about 40° to about 50°, and preferably about 45°. Further, it is contemplated that at least a portion of the inner surface 65' of the proximally facing section 62' can be curved in cross-sectional shape (with either a convex or concave cross-sectional shape) as the inner surface 65' tapers inwardly with respect to the longitudinal axis from locations furthest from the central bore 64' to locations adjacent to the central bore 64'. In optional aspects, it is contemplated that the distal end of one or more of the tines 32 of the flash suppressor 30 (FIG. 5) can be spaced from the proximally facing section 62' of the first baffle 60' or can extend therein at least partially into an interior chamber defined by the proximally facing circular male ridge 61' of the first baffle 60'.

In another aspect and as shown in FIGS. 5, 8A, 8B, 9A and 9B, a proximal end of each of the second baffles 60 can define a central bore 64 that can comprise a limited elongate length extending parallel to the longitudinal axis or optionally can form a transversely extending shoulder 66 that defines the central bore 64 and that expands the width of the central bore 64 immediately proximate to the proximal surface of the shoulder 66. In this aspect, it is contemplated that at least a portion of the interior surface of the distally facing surface 70 of the frusto-conical section 63 of the second baffle 60 can be curved in cross-sectional shape as the interior surface expands outwardly with respect to the longitudinal axis of the second baffle 60, toward the distal peripheral edge of the frusto-conical section 63 of the second baffle 60. Of course, it is also contemplated that at least a portion of the distally facing surface 70 of the second baffle 60 can be linear in cross-sectional shape.

In another aspect, the distally facing surface 70 of the frusto-conical section 63 of the second baffle 60 can have at least one circumferentially extending shoulder element 72 positioned proximate the distal edge of the frusto-conical section 63 to induce turbulence into the gas stream as the stream moves distally through the second baffle 60. In this aspect, the respective steps are preferably sequentially shaped to affect a stepped expansion of the operative width of the second baffle 60 proximate the juncture of the distal edge of the frusto-conical section 63 and the distally extending cylindrical spacer portion of the second baffle 60. In a further aspect, the distal peripheral edge of the second baffle 60, i.e., the distal end of the spacer portion of the second baffle 60, can be complementarily formed to mate with a peripheral edge portion of a downstream second baffle 60.

In another optional aspect, it is contemplated that at least one gas cross-flow aperture 80 can be positioned proximate the proximal end of the frusto-conical section 63 of the second baffle 60 to direct a substantially perpendicular gas jet onto the discharge gas stream as the discharge gas stream passes the shoulder 66 at the proximal end of the second baffle 60. As one skilled in the art will appreciate, the shoulder 66 can form a lip that extends peripherally about a large arcuate portion of the central bore 64 and helps to direct the flow of gas being injected therein the discharge stream through the at least one gas cross-flow aperture 80. In one preferred aspect, the at least one gas cross-flow aperture 80 of the second baffle 60 is elongate and can extend parallel to the longitudinal axis from proximate the shoulder 66 into a proximal portion of the frusto-conical section 63 of the second baffle 60.

Referring again to FIGS. 1-5, a means for selectively coupling the noise suppressor 50 to the flash suppressor 30 of the noise suppressor system 10 is illustrated. One skilled in the art will, by reference to the cross-sectional FIG. 5, the exploded FIG. 1, and the enlarged portions of the exploded illustration of FIG. 2, appreciate the means for creating a compressive coupling of a proximal mount assembly 100, which is coupled to the proximal end of the cylindrical housing 52 of the noise suppressor 50, to the respective tapered waist portion 38 and shoulder surface 42 of the flash suppressor 30.

Figure 2:
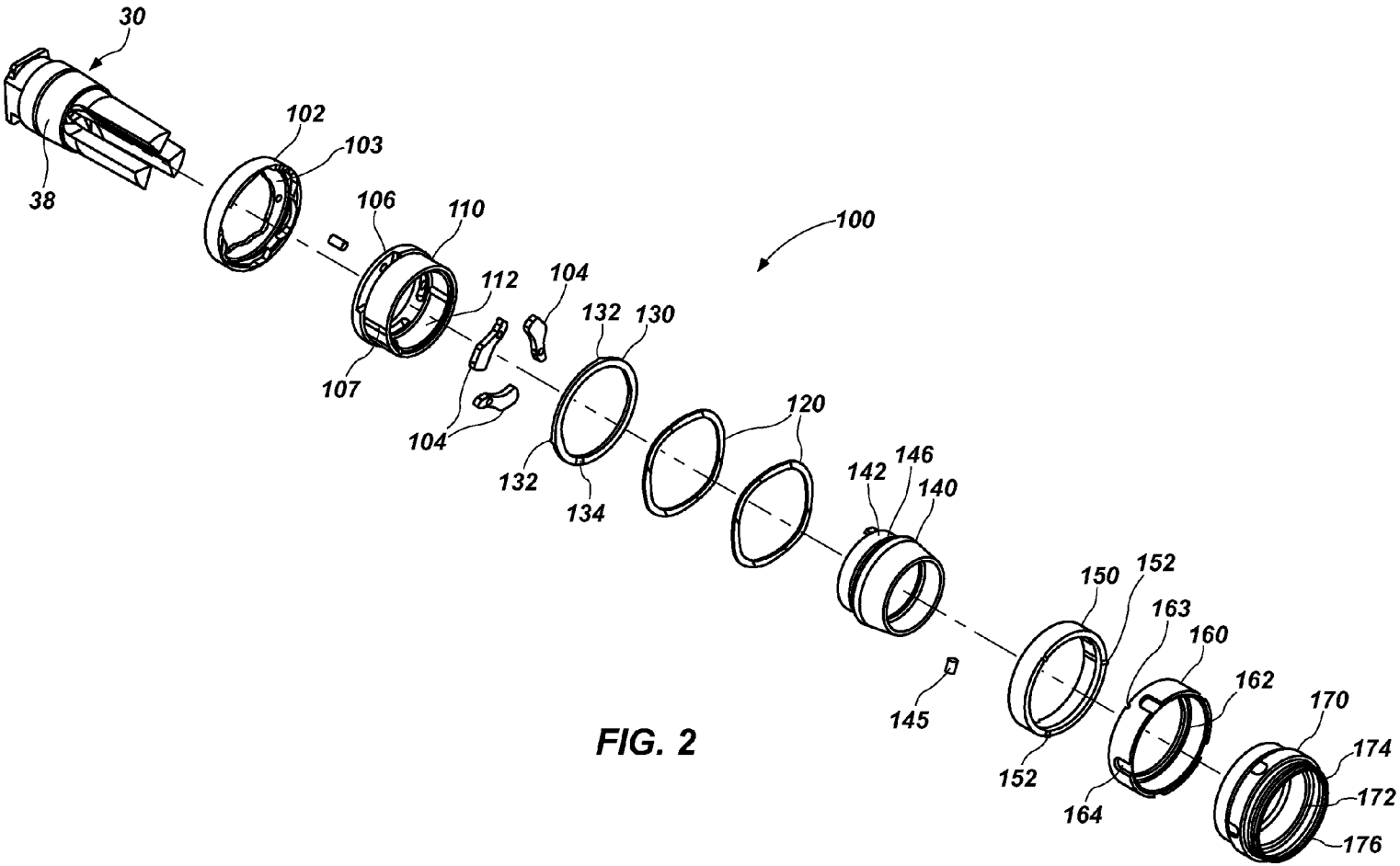
FIG. 2 is a perspective exploded view of a portion of the noise suppressor system of FIG. 1, according to one aspect and showing a proximal mount assembly having a means for selective attachment to the flash suppressor and to the cylindrical housing of a noise suppressor.

FIG. 2 is an enlarged exploded perspective view of a portion of the means for selectively coupling the noise suppressor 50 to the flash suppressor 30 showing a proximal attachment cap 102 that is rotatably coupled via interrupted complementary threads to a cap base member 110. As one skilled in the art will appreciate, a plurality of rotatable cam members 104 can be pin mounted therein a plurality of slots 106 defined in the base portion of the cap base member 110. Each cam member 104 can be selectively rotatable by biased application of cam surfaces on portions of the interior surface of the proximal attachment cap 102 upon rotation of the cap base member 110 relative to the proximal attachment cap 102. In this aspect, each cam member 104 is selectively rotatable between a withdrawn position, in which the cam member 104 is withdrawn to underlie a lip 103 of the end surface of the proximal attachment cap 102 that defines an opening sized for receipt of the base of the flash suppressor 30, and an operative position, in which the distal portion of each cam member 104 is urged outwardly and toward the longitudinal axis of the proximal mount assembly 100 to overlie a portion of a shoulder surface 42 (FIG. 12) of the flash suppressor 30.

In a further aspect, the distal portion 112 of the interior surface of the cap base member 110 is threaded for operative receipt of the external threads defined thereon the proximal end portion 142 of an intermediate mount member 140.

In another aspect, a plurality of spring members 120 and a first ring member 130 are shown that are sized and shaped for complementary receipt on the exterior surface of the distal portion of the non-threaded exterior surface of the cap base member 110. In this aspect, the first ring member 130 can have a plurality of male protrusions 132 extending proximally from the back surface of the first ring member, each male protrusion 132 of the first ring member 130 being configured for selective receipt therein complementary grooves 107 that are defined in the distal face of the peripheral edge of the proximal attachment cap 102. In another aspect, the first ring member 130 can further define a transversely oriented slot 134 on the front surface of the first ring member 130 for partial receipt of a transversely mounted pin. In a further aspect, each spring member 120, such as, for example and without limitation, a wave spring, can be shaped to provide compressive resistance between the front surface of the first ring member 130 and the proximal face surface of a second ring member 150.

Figure 1:
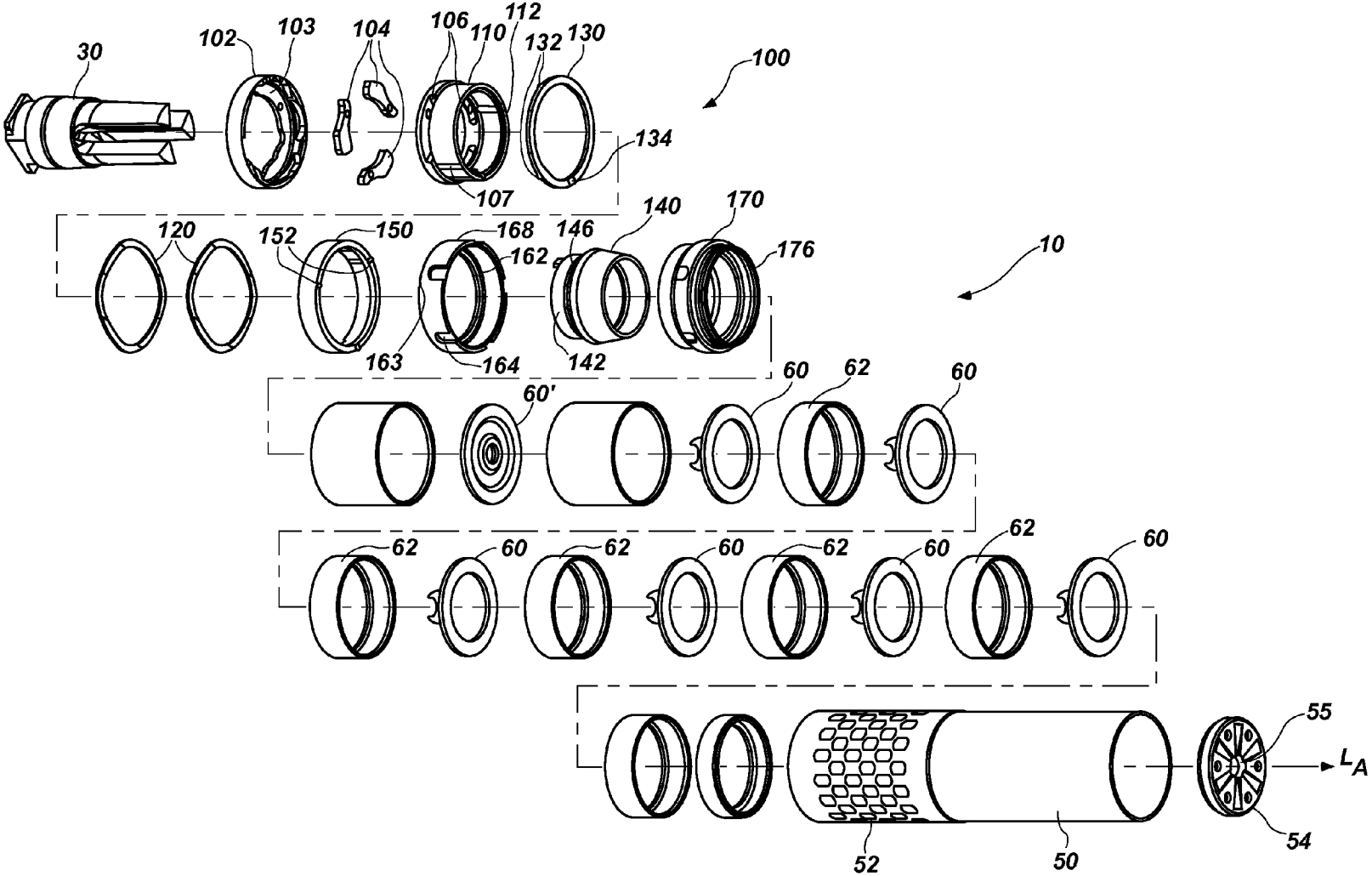
FIG. 1 is a perspective exploded view of a noise suppressor system for a firearm, according to one aspect. In one aspect, a proximal attachment cap is rotatably coupled to a cap base member, showing a plurality of rotatable cam members mounted therein a plurality of slots defined in the base portion of the cap base member, each cam member being selectively rotatable upon rotation of the cap base member relative to the proximal attachment cap about and between a withdrawn position, in which the cam member is withdrawn to underlie a lip that defines an opening sized for keyed fixed receipt of the base of the flash suppressor, and an operative position, in which the distal portion of the cam member is urged outwardly and toward the longitudinal axis of the proximal mount assembly to overlie a portion of a bottom shoulder surface of the flash suppressor. The distal portion of the interior surface of the cap base member is threaded for operative receipt of the external threads defined thereon the proximal end portion of the intermediate mount member. Further, a spring member and a first ring member are shown sized and shaped for receipt thereon the exterior surface of the distal portion of the non-threaded exterior surface of the cap base member. The first ring member has a plurality of male protrusions extending proximally from the back surface of the first ring member. Each male protrusion of the first ring member being configured for selective receipt therein complementary slots defined therein the distal face of the peripheral edge of the proximal attachment cap. The first ring member further defining a transversely oriented slot on the front surface of the first ring member for partial receipt of a transversely mounted pin. The spring member is shaped to provide compressive resistance between the front surface of the first ring member and the proximal face surface of the second ring member. In a further aspect, an intermediate mount member and the second ring member are shown. In this aspect, the proximal end portion of the intermediate mount member has a proximal peripheral edge having a cutout portion extending about a desired arcuate portion of the proximal peripheral edge. The cutout portion accepts the distal portion of the transversely mounted pin and, as one skilled in the art will appreciate, acts to limit the rotational motion of the cap base member relative to the coupled proximal attachment cap. Further, external threads are defined thereon the proximal end portion adjacent the proximal peripheral edge for operative receipt of the threaded interior surface of the cap base member. The second ring member has a plurality of male protrusions extending distally therefrom the bottom face of the second ring member. Each male protrusion of the second ring member being configured for selective receipt therein complementary radially spaced slots defined therein the distal face of the locking ring. Further, the central portion of the intermediate mount member is configured for hydraulic compressive coupling of the interior surface of the locking ring and the complementarily configured interior surface of the proximal portion of the top member. In an additional aspect, a locking ring and a top member are shown in which the locking ring has a plurality of radially spaced slots defined therein the distal face of the locking ring. The interior surface of the distal end portion of the top member has an inwardly tapered shape that is complementary to the tapered exterior surface of the distal end of the intermediate mount member. In one aspect, it is contemplated that the top member would be fixedly connected to the proximal end of the housing of the suppressor.

Perspective views of the intermediate mount member 140 and the second ring member 150 are also illustrated in FIGS. 1 and 2. In one aspect, the proximal end portion 142 of the intermediate mount member 140 can have a proximal peripheral edge with a cutout portion in the proximal peripheral edge. The cutout portion is sized to accept the distal portion of the transversely mounted pin 145 and, as one skilled in the art will appreciate, can thereby limit the rotational motion of the proximal attachment cap 102 relative to the cap base member 110. In a further aspect, external threads can be defined thereon the proximal end portion 142 adjacent the proximal peripheral edge for operative receipt of the threaded interior surface of the cap base member 110.

In one aspect, the second ring member 150 can have a plurality of male protrusions 152 extending distally from the front face of the second ring member 150. Each male protrusion 152 of the second ring member 150 can be configured for selective receipt in complementary radially spaced slots 163 defined therein the proximal face of the locking ring 160. Optionally, it is contemplated that the respective male protrusions 152 of the second ring member 150 can be spaced from one another at an angular relationship that insures less than all of the respective male protrusions 152 of the second ring member 150 can be selectively received in complementary radially spaced slots 163 defined in the proximal face of the locking ring 160 in any singular relative position. Thus, it is contemplated that only one of the respective male protrusions 152 of the second ring member 150 can be selectively received into its complementary radially spaced slot 163 defined in the proximal face of the locking ring 160 in any singular relative position.

In another aspect, a central portion 146 of the intermediate mount member 140 has external threads defined therein for rotational receipt of the complementarily threaded interior surface 162 of the locking ring 160 and a complementarily threaded interior surface 172 of a proximal portion 174 of a top member 170. Optionally, in another aspect, the central portion 146 of the intermediate mount member 140 can have a substantially smooth inwardly tapering frusto-conical surface that is configured to affect an operational hydraulic compressive coupling to a substantially smooth complementary interior surface 162 of the locking ring 160 and to a substantially smooth complementary interior surface 172 of the proximal portion 174 of the top member 170.

In one aspect, the locking ring 160 can have a plurality of radially spaced slots 164 defined in the proximal face of the locking ring 160. In another aspect, the interior surface of the distal end portion 176 of the top member 170 can have an inwardly tapered shape that is complementary to the tapered exterior surface of the distal end of the intermediate mount member 140. In optional aspects, it is contemplated that the top member 170 would be selectively or fixedly connected to the proximal end of cylindrical housing 52 of the noise suppressor 50.

Figure 12:
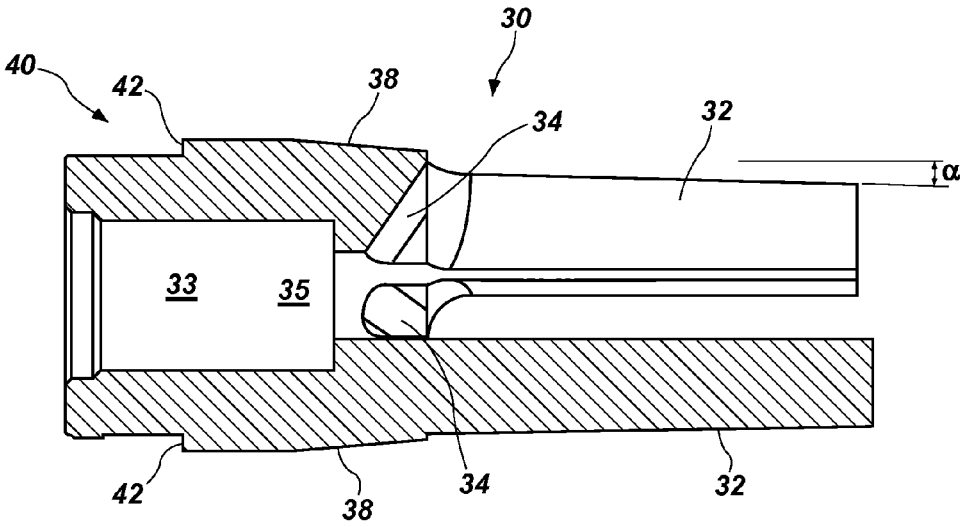
FIG. 12 is a cross-sectional view of the flash suppressor of FIG. 10, taken along lines 12-12 of FIG. 11.
Figure 13:
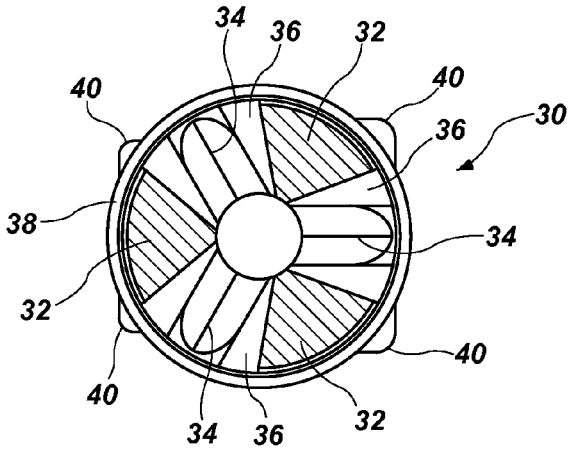
FIG. 13 is a cross-sectional view of the flash suppressor of FIG. 10, taken along lines 13-13 of FIG. 11.
Figure 14:
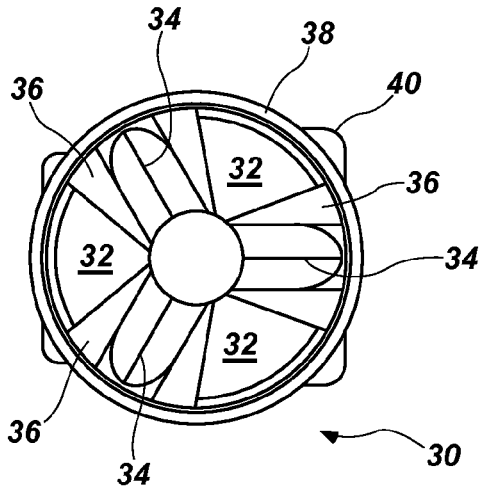
FIG. 14 is a distal plan view of the flash suppressor of FIG. 10.

With added reference to FIGS. 12 and 13, in operation, in order to selectively mount the noise suppressor 50 to the flash suppressor 30, the proximal attachment cap 102 is rotationally fixed as a result of the keyed relationship between the keyed opening in the proximal attachment cap 102 and the complementary key surface 40 of the flash suppressor 30. Subsequently, the rotation of the proximal mount assembly 100 initially operatively extends the respective cam members 104 to the operative, extended, position and then compressively draws a tapered interior surface of the intermediate mount member 140 into operative contact with the complementary tapered waist portion 38 of the flash suppressor 30 while simultaneously drawing the cam members 104 into operative contact with the shoulder surface 42 at the proximal end of the flash suppressor 30.

To release the noise suppressor 50 from the flash suppressor 30, rotation in the opposite direction is affected, which results in the operative spacing of the contact portions of the proximal mount assembly 100 and the flash suppressor 30. The last operation to release the noise suppressor 50 results in the movement of the respective cam members 104 to the withdrawn position, which allows separation of the noise suppressor 50 from the flash suppressor 30.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A flash suppressor system for a firearm, comprising:

a flash suppressor selectively mountable to a distal end of a barrel of the firearm, the flash suppressor including a plurality of tines, each tine of the plurality of tines having a different mass from every other tine of the plurality of tines, the different mass configured to minimize harmonic sound from the flash suppressor as gases exiting a muzzle of the firearm when the firearm is discharged and to disperse the gases in a manner that reduces flash without affecting an accuracy of discharged projectiles.

2. The flash suppressor system of claim 1, wherein each of the respective masses of the tines can vary by less than 1%.

3. The flash suppressor system of claim 1, wherein the respective masses of the tines can vary by less than 10%.

4. The flash suppressor system of claim 1, wherein the respective masses of the tines can vary by less than 20%.

5. The flash suppressor system of claim 1, wherein the respective masses of the tines can vary by at least 1%.

6. The flash suppressor system of claim 1, wherein the respective masses of the tines can vary by at least 3%.

7. The flash suppressor system of claim 1, wherein the respective masses of the tines can vary by at least 5%.

8. The flash suppressor system of claim 1, wherein the respective elongate lengths of the tines of the plurality of tines are different from one another.

9. The flash suppressor system of claim 1, wherein the flash suppressor includes a cylindrical socket having a threaded recess for selective receiving a threaded extension of a gun barrel of the firearm.

10. The flash suppressor system of claim 9, wherein the cylindrical socket includes an axial central bore having a diameter that is larger than a bore of the firearm.

11. The flash suppressor system of claim 10, wherein a body of the flash suppressor surrounding an exit chamber of the flash suppressor has a plurality of troughs equally spaced, angled and running a length of an exit chamber of the flash suppressor and a plurality of slots continuous with the plurality of troughs and extending longitudinally in a distal portion of the flash suppressor, between adjacent tines of the plurality of lines.

12. The flash suppressor system of claim 11, wherein each trough of the plurality of troughs has a concave profile.

13. The flash suppressor system of claim 12, wherein each trough of the plurality of troughs is offset from a corresponding tine of the plurality of tines.

14. The flash suppressor system of claim 1, wherein an exterior surface of a body of the flash suppressor includes a waist portion tapering from a first diameter at a proximal location to a smaller, second diameter at a distal location.

15. The flash suppressor system of claim 1, wherein at least a portion of an exterior surface of the plurality of tines tapers from a proximal location to a distal location toward a central longitudinal axis of the flash suppressor.

* * * * *

UNITED STATES PATENT AND TRADEMARK OFFICE

CERTIFICATE OF CORRECTION

PATENT NO. : 8,794,376 B2
APPLICATION NO. : 13/743331
DATED : August 5, 2014
INVENTOR(S) : Shults et al.

It is certified that error appears in the above-identified patent and that said Letters Patent is hereby corrected as shown below:

In the Specification,

Column 1, Lines 10-11, change "patent application Ser. No." to --Patent Application No.--

In the Claims,

Column 12, Line 50, change "lines." to --tines.--

Signed and Sealed this
Twenty-fifth Day of November, 2014

Michelle K. Lee

Michelle K. Lee
*Deputy Director of the United States Patent and Trademark Office*